US008444458B2

(12) United States Patent
Culler et al.

(10) Patent No.: US 8,444,458 B2
(45) Date of Patent: May 21, 2013

(54) PLASMA TREATED ABRASIVE ARTICLE AND METHOD OF MAKING SAME

(75) Inventors: Scott R. Culler, Burnsville, MN (US); Moses M. David, Woodbury, MN (US); William C. Quade, Stillwater, MN (US); Brian J. Brinkmeier, Rosemount, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 347 days.

(21) Appl. No.: 12/742,349

(22) PCT Filed: Dec. 8, 2008

(86) PCT No.: PCT/US2008/085843

§ 371 (c)(1),
(2), (4) Date: May 11, 2010

(87) PCT Pub. No.: WO2009/088606

PCT Pub. Date: Jul. 16, 2009

(65) Prior Publication Data

US 2010/0255254 A1 Oct. 7, 2010

Related U.S. Application Data

(60) Provisional application No. 61/018,045, filed on Dec. 31, 2007, provisional application No. 61/096,484, filed on Sep. 12, 2008.

(51) Int. Cl.

| | |
|---|---|
| ***B24D 11/00*** | (2006.01) |
| ***B24B 37/26*** | (2006.01) |
| ***C09G 1/00*** | (2006.01) |

(52) U.S. Cl.
USPC ..... 451/539; 451/528; 451/534; 51/295; 51/307

(58) Field of Classification Search
USPC ..... 51/295, 307, 308; 451/296, 528, 451/534, 539
See application file for complete search history.

(56) References Cited

U.S. PATENT DOCUMENTS

| | | | |
|---|---|---|---|
| 4,311,489 | A | 1/1982 | Kressner |
| 4,609,581 | A | 9/1986 | Ott |
| 4,652,274 | A | 3/1987 | Boettcher et al. |
| 4,652,275 | A | 3/1987 | Bloecher et al. |
| 4,735,632 | A | 4/1988 | Oxman et al. |
| 4,751,138 | A | 6/1988 | Tumey et al. |
| 4,799,939 | A | 1/1989 | Bloecher et al. |

(Continued)

FOREIGN PATENT DOCUMENTS

| | | | |
|---|---|---|---|
| CN | 1498723 | A | 5/2004 |
| JP | 07-088773 | | 4/1995 |
| JP | 07-096468 | A2 | 4/1995 |
| JP | 2001-334473 | A | 4/2001 |

*Primary Examiner* — Pegah Parvini
(74) *Attorney, Agent, or Firm* — Scott A. Baum

(57) ABSTRACT

An abrasive article, such as a structured abrasive article, can be treated by subjecting it to plasma whereby the outer surface can be eroded exposing at least a portion of the abrasive particles dispersed within a cross-linked binder forming the abrasive composites. Depending on the process conditions for the plasma treatment, it is possible to erode only a small portion or substantially all of the cross-linked binder from the outer surface. Thus, the initial cut-rate of the abrasive article can be controlled since it is possible to precisely control the degree, height, or area of the exposed abrasive particles.

12 Claims, 7 Drawing Sheets

U.S. PATENT DOCUMENTS 4,903,440 A 2/1990 Larson et al.
4,985,340 A 1/1991 Palazzotto et al.
5,086,086 A 2/1992 Brown-Wensley et al.
5,152,917 A 10/1992 Pieper et al.
5,236,472 A 8/1993 Kirk et al.
5,254,194 A 10/1993 Ott et al.
5,286,782 A 2/1994 Lamb et al.
5,304,223 A 4/1994 Pieper et al.
5,354,797 A 10/1994 Anderson et al.
5,376,428 A 12/1994 Palazzotto et al.
5,378,251 A 1/1995 Culler et al.
5,385,954 A 1/1995 Palazzotto et al.
5,435,816 A 7/1995 Spurgeon et al.
5,437,754 A 8/1995 Calhoun
5,454,844 A 10/1995 Hibbard et al.
5,672,097 A 9/1997 Hoopman
5,672,186 A 9/1997 Chesley et al.
5,681,217 A 10/1997 Hoopman et al.
5,833,724 A 11/1998 Wei et al.
5,851,247 A 12/1998 Stoetzel et al.
5,863,306 A * 1/1999 Wei et al. ..... 51/295
5,888,594 A 3/1999 David et al.
5,908,476 A 6/1999 Nishio et al.
5,948,166 A 9/1999 David et al.
5,975,987 A 11/1999 Hoopman et al.
6,048,375 A 4/2000 Yang et al.
6,139,594 A 10/2000 Kincaid et al.
6,293,980 B2 9/2001 Wei et al.
6,428,898 B1 8/2002 Barsotti et al.
6,451,076 B1 9/2002 Nevoret et al.
6,544,593 B1 4/2003 Nagata et al.
6,848,986 B2 * 2/2005 Kendall et al. ..... 451/526
7,195,360 B2 3/2007 Bacon, Jr. et al.
2001/0041511 A1 11/2001 Lack et al.
2003/0022604 A1 1/2003 Annen et al.
2003/0134515 A1 7/2003 David et al.
2003/0143938 A1 7/2003 Braunschweig et al.
2003/0207658 A1 11/2003 Nevoret et al.
2004/0118051 A1 6/2004 Shiho
2005/0064805 A1 3/2005 Culler et al.
2007/0093181 A1 4/2007 Lugg et al.
2007/0254560 A1 11/2007 Woo et al.
2009/0017727 A1 1/2009 Pribyl et al.

* cited by examiner 5 min. 20μm 5 min. 10μm

PLASMA TREATED ABRASIVE ARTICLE AND METHOD OF MAKING SAME

This application is a 371 of PCT/US08/85843 which claims benefit of 61/018,045 filed Dec. 31, 2007, and claims benefit of 61/096,484 filed Sep. 12, 2008.

BACKGROUND

Abrasive articles generically known as structured abrasive articles are sold commercially for use in surface finishing. Structured abrasive articles have a topographically structured abrasive layer affixed to a backing. The structured abrasive layer has a plurality of shaped abrasive composites with each composite having abrasive particles dispersed in a cross-linked binder. In many cases, the shaped abrasive composites are precisely-shaped using a mold to form various geometric shapes (e.g., pyramids). Examples of such structured abrasive articles include those marketed under the trade designation "TRIZACT" by 3M Company, St. Paul, Minn. Structured abrasive articles can be used in the automotive industry to remove defects in automotive clear coats based on urethane, acrylate, or silicate chemistries. An abrasive article particularly suited to removing clear coat defects is available under the trade designation 466LA-3M TRIZACT FINESSE-IT FILM.

Structured abrasive articles can lack aggressive cut upon initial use, with improvements in cut seen with continued use. This can occur because the abrasive particles are buried in the cross-linked binder within the body of the abrasive composite and are not available for abrading. One technique used in the art for addressing the problem of lower initial cut has been to precondition the outer surface of the structured abrasive article, prior to its initial use, using another abrasive article or an abrasive slurry to abrade the outer surface. However, such a technique lacks precise control and is time consuming for large scale production of abrasive articles.

Another technique involves applying loose abrasive grains on top of an abrasive slurry before embossing a pattern to form the structured abrasive layer and then curing the abrasive slurry as disclosed in U.S. Pat. No. 5,863,306 to Wei. However, many of the abrasive grains on the outer surface are still covered by the cross-linked binder in the abrasive slurry as it is squished through the abrasive grains and rearranged by the embossing process. Furthermore, many abrasive grains are left unbonded or weakly bonded to the outer surface of the abrasive layer. This can cause problems when making the abrasive article and cause undesirable performance when using the abrasive article. To combat these issues, a subsequent application of an additional top size coat as discussed in U.S. Pat. No. 6,451,076 to Nevoret is typically required, which increases costs and can reduce initial cut rate since the abrasive grain is no longer fully exposed.

Another technique involves using a water-soluble polymer to position abrasive grains on the structured abrasive layer as discussed in U.S. pending patent application Ser. No. 11/777,701 filed on Jul. 13, 2007 entitled "Structured Abrasive Layer, And Method of Making and Using Same." However, water is needed during use of the abrasive article to dissolve the water-soluble polymer, and it takes time before the loose abrasive grains can erode the surface of the structured abrasive layer exposing the abrasive particles held within the shaped abrasive composites.

Another technique involves using a low energy plasma etching process as discussed in JP2001334473A, which is applied to a polishing article comprising a single layer of abrasive particles having a uniform height. However, the technique disclosed results in anisotropic etching which would not uniformly etch a structured abrasive article having significant topography for the shaped abrasive composites that form the structured abrasive layer. The disclosed technique uses lower pressures, power settings, and either pure oxygen or argon gases, which results in anisotropic etching conditions. These conditions only etch the planar surfaces of the abrasive article parallel to the backing. If the disclosed etching conditions were used to plasma etch a structured abrasive article, areas of the structured abrasive layer that are not parallel to the backing, such as sloping or vertical sidewalls of the shaped abrasive composites, would be etched less or not etched at all. The resulting abrasive article would have significant non-uniformity occurring as a result of the anisotropic etching process.

SUMMARY

The inventors have discovered that by treating an abrasive article, such as a structured abrasive article, by subjecting it to plasma, the cross-linked binder forming the abrasive composites can be eroded away from the outer surface of the structured abrasive layer thereby uniformly exposing at least a portion of the abrasive grain dispersed within the shaped abrasive composite. Depending on the process conditions for the plasma treatment, it is possible to erode only a small portion or substantially all of the cross-linked binder from the outer surface. Thus, the initial cut-rate of the abrasive article can be controlled since it is possible to precisely control the degree, height, or area of the exposed abrasive grains. Surprisingly, even when substantially all of the cross-linked binder is removed from the outer surface of the structured abrasive layer such that mostly the abrasive grains are visually present, the abrasive grains remain attached to the abrasive composite since the underlying cross-linked binder holding the abrasive grains is not affected by the plasma treatment.

The plasma treatment uses process conditions to yield isotropic etching such that the degree of exposure of the abrasive particles is substantially uniform regardless of the location on the shaped abrasive composite. It is believed that the uniform exposure improves the cut rate and life of the abrasive article. The isotropic plasma treatment can lower the atomic carbon percentage of the outer surface such that it can be determined if the abrasive article has been plasma treated.

Hence, in one aspect, the disclosure resides in a structured abrasive article comprising a structured abrasive layer attached to a first major surface of a backing; the structured abrasive layer comprising a plurality of shaped abrasive composites formed by a plurality of abrasive particles in a cross-linked binder; the structured abrasive layer having an outer surface and the outer surface comprising a plurality of precisely-exposed abrasive particles.

In another aspect, the disclosure resides in a structured abrasive article comprising a structured abrasive layer attached to a first major surface of a backing; the structured abrasive layer comprising a plurality of shaped abrasive composites formed by a plurality of abrasive particles in a cross-linked binder; and the structured abrasive layer having an outer surface and the outer surface comprising a carbon content of less than about 60 atomic %.

In another aspect, the disclosure resides in a method comprising contacting an outer surface of a structured abrasive layer with an oxygen containing plasma; the structured abrasive layer comprising a plurality of shaped abrasive composites formed by a plurality of abrasive particles in a cross-linked binder, and the structured abrasive layer is attached to a first major surface of a backing.

BRIEF DESCRIPTION OF THE DRAWINGS

It is to be understood by one of ordinary skill in the art that the present discussion is a description of exemplary embodiments only, and is not intended as limiting the broader aspects of the present invention, which broader aspects are embodied in the exemplary construction.

Figure 1A:
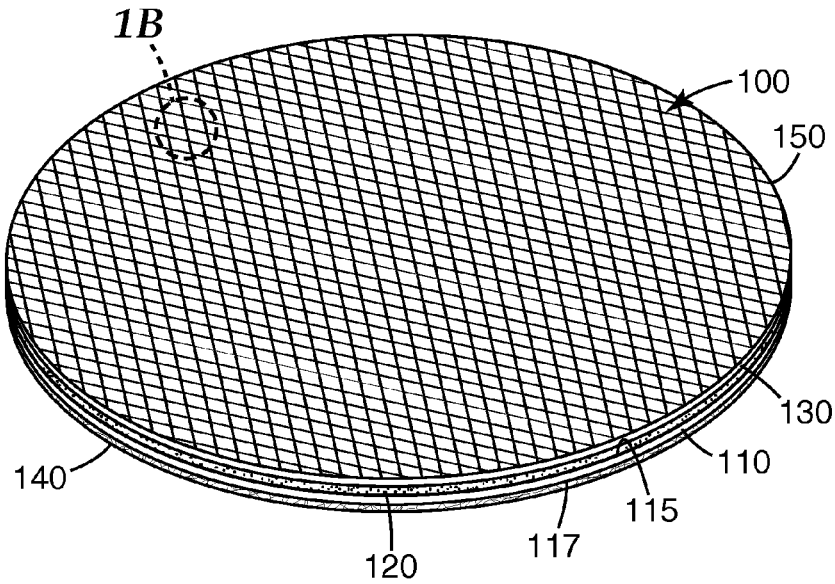
FIG. 1A illustrates an abrasive article.

Repeated use of reference characters in the specification and drawings is intended to represent the same or analogous features or elements of the invention.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein, a "structured abrasive layer" is formed by a plurality of shaped abrasive composites comprising a cross-linked binder and a plurality of abrasive particles. The shaped abrasive composites can be attached to a backing forming a coated abrasive article. The shaped abrasive composites on the backing can be randomly positioned or arranged into a repeating pattern. The shaped abrasive composites can vary in shape, size, height, spatial density, or other physical property on the backing Several methods can be used to form a structured abrasive layer. In one method, an abrasive slurry comprising a cross-linkable binder and abrasive particles is printed onto a backing using a rotogravure coater to form the plurality of shaped abrasive composites. In another method, an abrasive slurry can be deposited onto a backing and then embossed to form the plurality of shaped abrasive composites as disclosed in U.S. Pat. Nos. 5,863,306; 5,833,724; and 6,451,076. In yet another method, an abrasive slurry can be deposited into a mold having a plurality of cavities the inverse of the desired pattern and the cross-linkable binder at least partially cured to form the plurality of shaped abrasive composites as disclosed in U.S. Pat. Nos. 5,152,917; 5,304,223; 5,378,251; and 5,437,754.

As used herein, a "precisely-shaped abrasive composite" is formed by an abrasive slurry residing in a cavity in a mold that is at least partially cured before being removed from the mold. Unlike rotogravure printing or embossing methods to produce the shaped abrasive composites, the molding/partial cure process produces shaped abrasive composites that have significantly better shape retention, edge delineation, and have a surface or shape that substantially replicates the mold's surface by being at least partially cured while residing in the mold.

As used herein, "precisely-exposed abrasive particle" means that the cross-linked binder that the abrasive particle resides in has been at least partially removed by plasma etching such that at least a portion of the abrasive particle is exposed or higher than the surrounding cross-linked binder. As such, the edges of the exposed portion of the abrasive particle are rendered sharp and distinct. The demarcation line between the exposed portion of the abrasive particle and the cross-linked binder is sharp and distinct, and the interface is substantially free of smearing due to mechanical action (embossing) or wicking due to capillary action. The exposed portion of the abrasive particle is substantially free of any residual cross-linked binder.

As used herein, "close-packed" means that the base of each pyramidal abrasive composite (or opening of each cavity) abuts adjacent pyramidal abrasive composites (or cavities), truncated or not, along its entire circumference, except at the perimeter of the abrasive layer or mold where of course this would not be possible.

As used herein, "consisting essentially of close-packed abrasive composites" (e.g., truncated pyramidal abrasive composites or pyramidal abrasive composites) means that while a degree of variation (e.g., in height, shape, or density) is encompassed (e.g., as arising from the manufacturing process used), that variation cannot materially affect the abrasive properties of the structured abrasive article (e.g., cut, product life, or smoothness of the resultant surface finish).

As used herein, "consisting essentially of close-packed cavities" (e.g., truncated pyramidal cavities or pyramidal cavities) means that while a degree of variation (e.g., in depth, shape, or density) is encompassed (e.g., as arising from the manufacturing process used), that variation cannot materially affect the abrasive properties of the resultant structured abrasive article (e.g., cut, product life, or smoothness of the resultant surface finish).

DETAILED DESCRIPTION

Figure 1C:
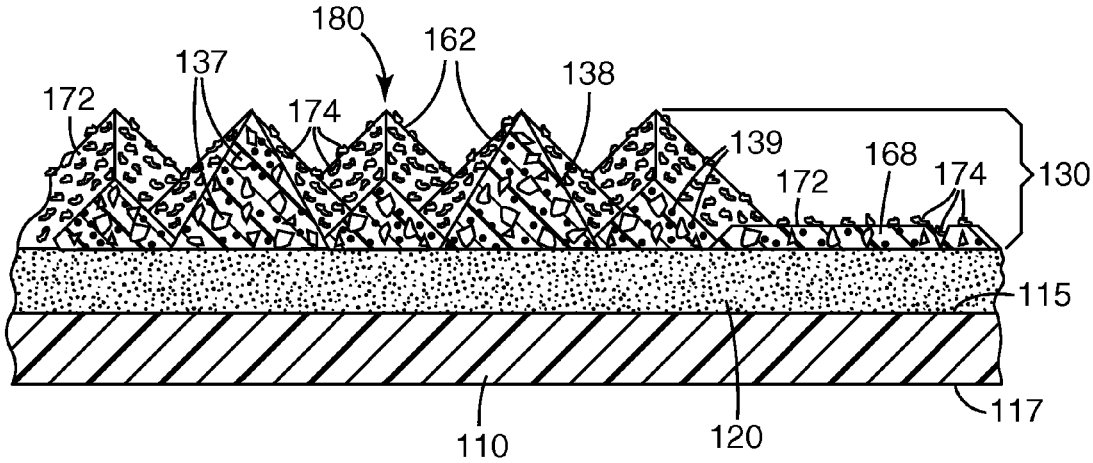
FIG. 1C is a cross section taken at 1C-1C of FIG. 1B illustrating the exposed abrasive particles in the structured abrasive layer produced by plasma treatment of the abrasive article of FIG. 1A.
Figure 1B:
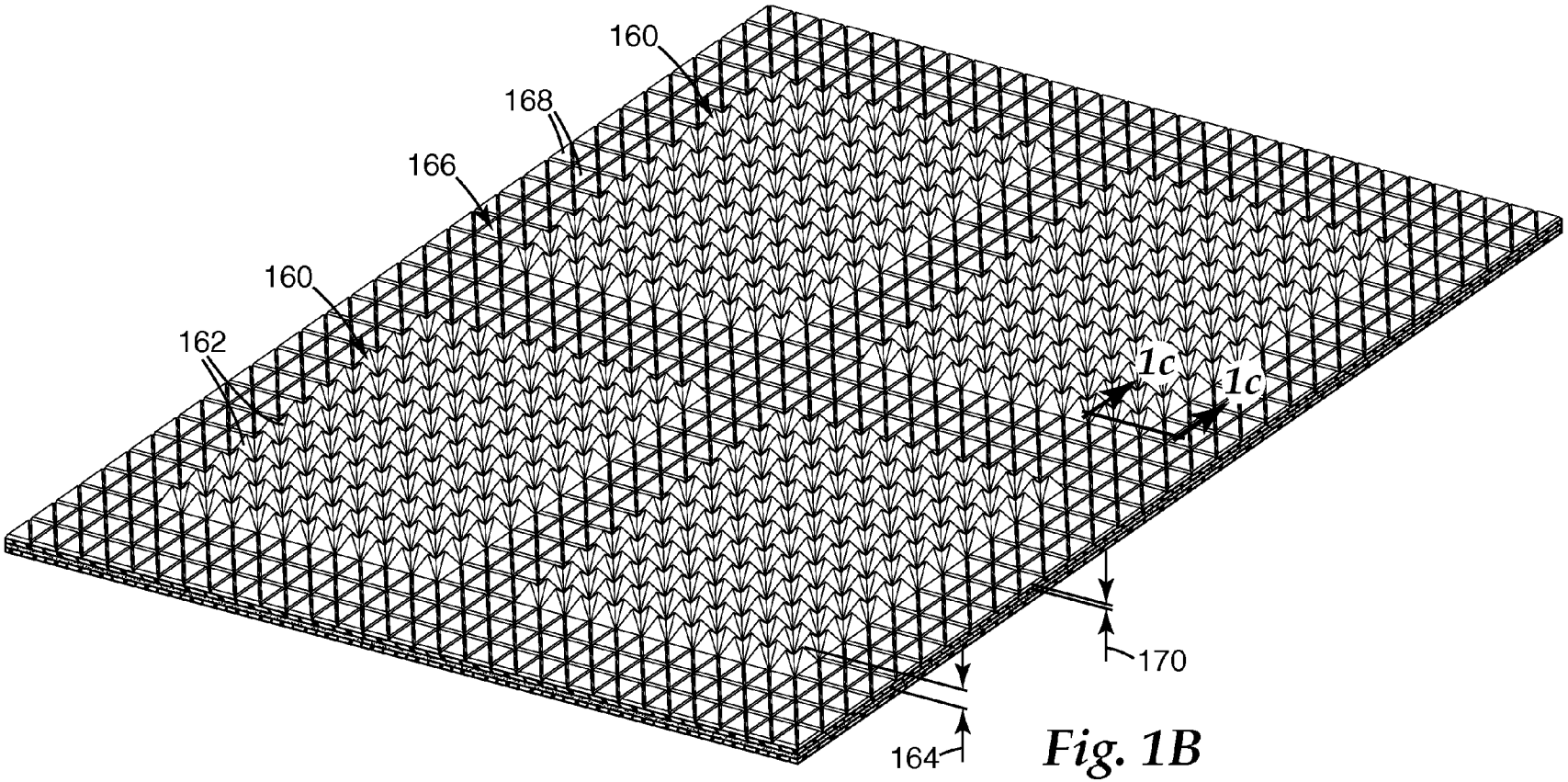
FIG. 1B illustrates a close up view of the structured abrasive layer at circled area 1B of FIG. 1A.

Abrasive articles can comprise a structured abrasive layer affixed to a first major surface of a backing A structured abrasive article is shown in FIGS. 1A-1C. Referring now to FIG. 1A, structured abrasive disk 100 has backing 110 with first and second major surfaces, 115 and 117, respectively. Optional adhesive layer 120 contacts and is affixed to and coextensive with first major surface 115. Structured abrasive layer 130 has outer boundary 150 and contacts and is affixed to and coextensive with, either first major surface 115 of backing 110 (if optional adhesive layer 120 is not present) or optional adhesive layer 120 (if present). As shown in FIG. 1B, structured abrasive layer 130 comprises a plurality of raised abrasive regions 160 and network 166. Each raised abrasive region 160 consists essentially of a close-packed plurality of pyramidal abrasive composites 162 having a first height 164. Network 166 consists essentially of close-packed truncated pyramidal abrasive composites 168 having a second height 170. Network 166 continuously abuts and separates raised abrasive regions 160 from one another and is coextensive with outer boundary 150. The height first of pyramidal abrasive composites 162 is greater than the second height 170 of the truncated pyramidal abrasive composites 168. Optional mechanical attachment interface layer 140 is affixed to second major surface 117.

It is believed that the combination of pyramidal abrasive composites and a network of truncated pyramidal abrasive composites according to the above description facilitates waste (e.g., swarf) removal and effectively captures dust nibs, increases the proportion of frictional pressure distributed to the pyramidal composites during abrading processes (particularly helpful in manual abrading processes), and reduces stiction.

Referring now to FIG. 1C, pyramidal abrasive composites 162 and truncated pyramidal abrasive composites 168, each comprise abrasive particles 137 and cross-linked binder 138. At least a portion of the outer surface 180 of structured abrasive layer 130 comprises a plurality of precisely-exposed abrasive particles 174. The precisely-exposed abrasive particles are formed by subjecting at least a portion of the outer surface 180 to plasma. The ionized plasma erodes or removes the cross-linked binder 138 from the outer surface 180 gradually exposing more surface area of the underlying abrasive particles.

In various embodiments of the invention, about 5 percent to about 90 percent of the total surface area, or about 10 percent to about 90 percent of the total surface area, or about 25 percent to about 90 percent of the total surface area, or about 50 percent to about 90 percent of the total surface area, or about 75 percent to about 90 percent of the total surface area of the abrasive particles 137 is precisely-exposed and free of the cross-linked binder 138.

Figure 2A:
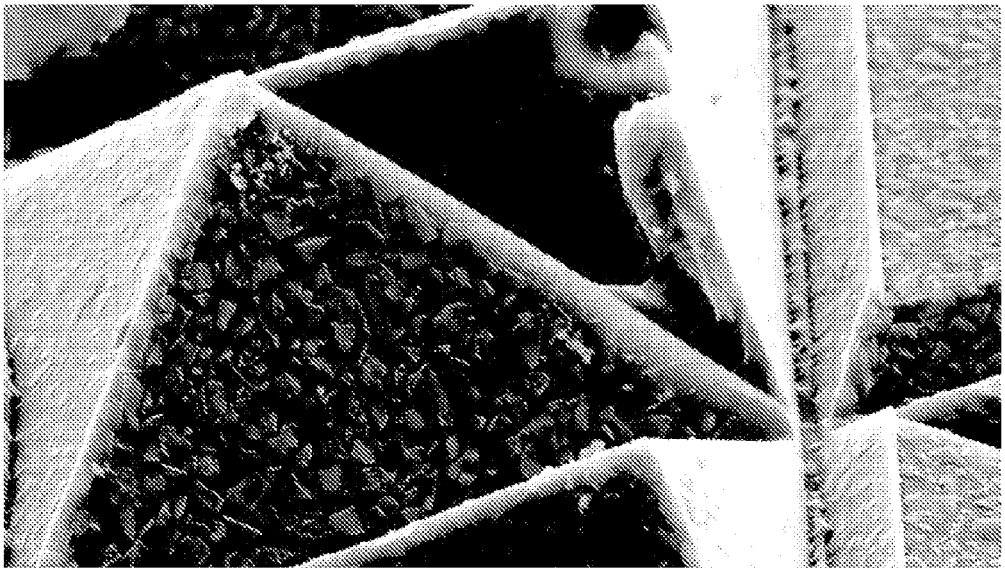
FIG. 2A is a scanning electron micrograph of the outer surface of a structured abrasive layer after 2 minutes of plasma treatment taken at approximately 800× magnification.
Figure 2B:
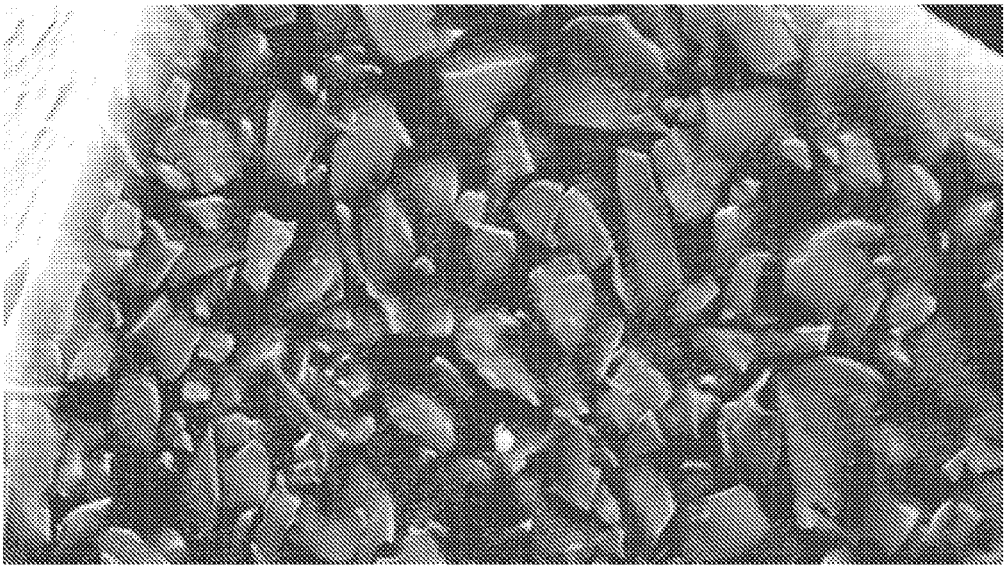
FIG. 2B is a scanning electron micrograph of the outer surface of a structured abrasive layer after 2 minutes of plasma treatment taken at approximately 2000× magnification.

Referring now to FIGS. 2A and 2B, after two minutes of plasma treatment less than about 50% of the surface area of the outer surface 180 of the structured abrasive layer 130 comprises precisely-exposed abrasive particles. Significant portions of the outer surface 180 are formed from the cross-linked binder 138 and have a relatively smooth appearance. The edges of the pyramidal abrasive composites 162 are predominately the cross-linked binder 138, while the precisely-exposed abrasive particles 174 are present mainly in the faces of the shaped abrasive composites. The precisely exposed abrasive particles 174 protrude slightly from the cross-linked binder 138 thereby increasing the surface roughness. As seen, the degree of exposure for the abrasive particles is substantially uniform at all positions on the structured abrasive layer 130 including the tops of the shaped abrasive composites and the valleys between adjacent shaped abrasive composites.

Figure 3A:
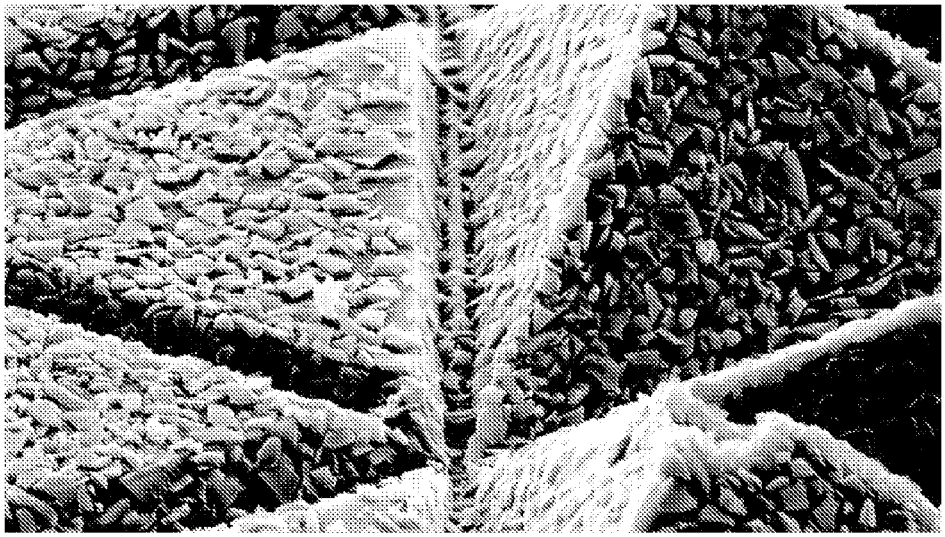
FIG. 3A is a scanning electron micrograph of the outer surface of a structured abrasive layer after 5 minutes of plasma treatment taken at approximately 800× magnification.
Figure 3B:
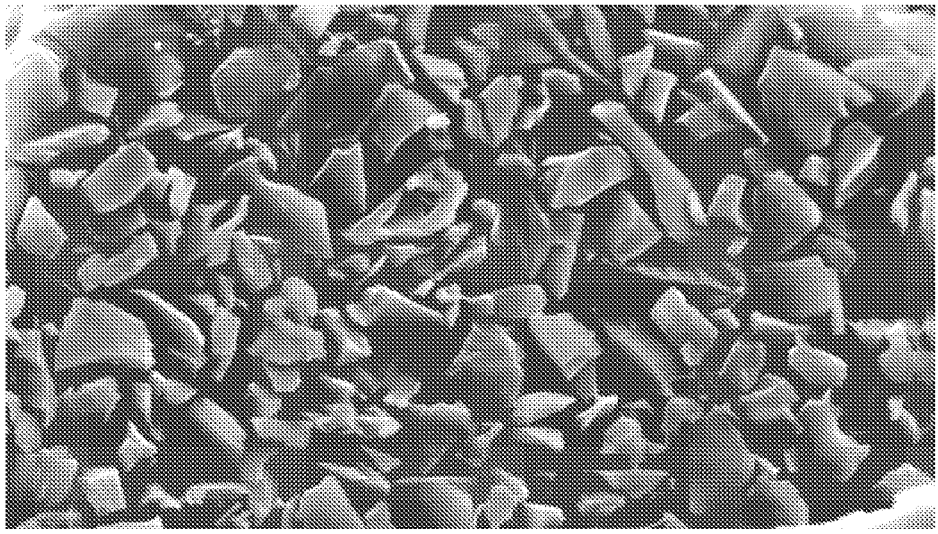
FIG. 3B is a scanning electron micrograph of the outer surface of a structured abrasive layer after 5 minutes of plasma treatment taken at approximately 2000× magnification.

Referring now to FIGS. 3A and 3B, after five minutes of plasma treatment greater than about 50% of the surface area of the outer surface 180 of the structured abrasive layer 130 comprises precisely-exposed abrasive particles. Significant portions of the outer surface 180 are formed from the precisely exposed abrasive particles providing a much higher surface roughness. The edges of the pyramidal abrasive composites 162 are predominately individual precisely-exposed abrasive particles, although some portion of the cross-linked binder 138 is still present. The majority of the area present in the faces of the shaped abrasive composites (162, 168) is covered by the precisely-exposed abrasive particles 174. The precisely-exposed abrasive particles 174 protrude significantly from the cross-linked binder 138 thereby significantly increasing the surface roughness. As seen, the degree of exposure for the abrasive particles is substantially uniform at all positions on the structured abrasive layer including the tops, faces, and edges of the shaped abrasive composites and the valleys between adjacent shaped abrasive composites.

Figure 4A:
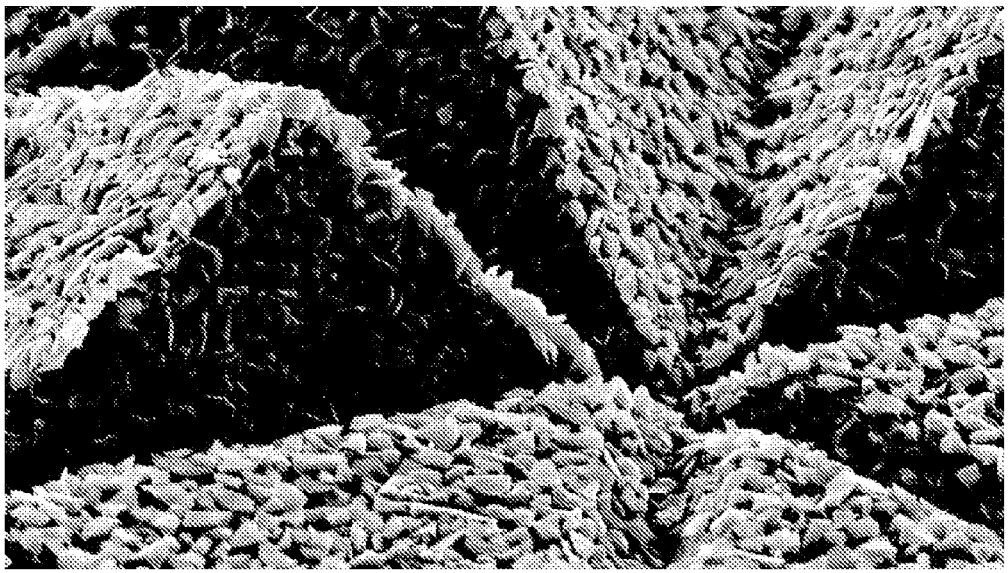
FIG. 4A is a scanning electron micrograph of the outer surface of a structured abrasive layer after 10 minutes of plasma treatment taken at approximately 800× magnification.
Figure 4B:
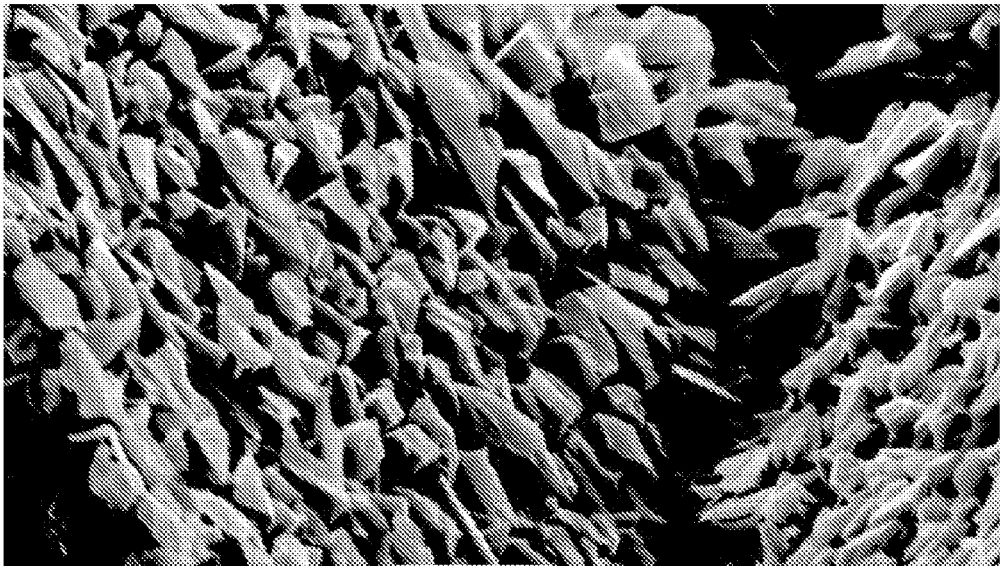
FIG. 4B is a scanning electron micrograph of the outer surface of a structured abrasive layer after 10 minutes of plasma treatment taken at approximately 2000× magnification.

Referring now to FIGS. 4A and 4B, after 10 minutes of plasma treatment greater than about 90% of the surface area of the outer surface 180 of the structured abrasive layer 130 comprises precisely-exposed abrasive particles. Almost the entire outer surface 180 is formed from the precisely-exposed abrasive particles providing a significantly higher surface roughness. The edges of the pyramidal abrasive composites 162 are predominately individual precisely-exposed abrasive particles and only a small portion of the cross-linked binder 138 is still present. The area present in the faces of the shaped abrasive composites (162, 168) is almost entirely covered by the precisely-exposed abrasive particles 174. The precisely-exposed abrasive particles 174 appear as if individual particles were adhered one by one to the faces until all of the cross-linked binder 138 was covered. It is extremely interesting to note that independent of the geometry present, the amount of exposure of the precisely-exposed abrasive particles is substantially the same. Note the degree of exposure for the valleys between abutting shaped abrasive composites and the degree of exposure on the faces or along the edges where the faces meet, or at the top of the shaped abrasive composites. In all areas, the precisely-exposed abrasive particles protrude from the cross-linked binder 138 approximately the same amount.

Without wishing to be bound by theory, it is believed that having the precisely-exposed abrasive particles in the valleys and on the sides and tops of the shaped abrasive composites provides a significant advantage even though the precisely-exposed abrasive particles may not initially touch the surface of the work piece. In particular, a portion of the sides of the shaped abrasive composites can be a working abrasive surface depending on the material being abraded. Clear coats, paints and other relatively soft materials can allow the shaped abrasive composites to cut more deeply into the paint layer working both the tops and the sides of the shaped abrasive composites. When only the tops of the shaped abrasive composites have exposed abrasive particles, cut rates can be reduced. Second, having precisely-exposed abrasive particles in the valleys and on the sides of the non-contacting surfaces is believed to provide greater life of the abrasive article. The precisely-exposed abrasive particles are present to help erode the cross-linked binder as the heights of the shaped abrasive composites are decreased from use. As such, fresh, sharp precisely-exposed abrasive particles are present throughout the entire structured abrasive layer until the structured abrasive layer is completely worn away.

In another embodiment of the invention, the structured abrasive layer 130 has a plurality of abrasive composites formed from the plurality of abrasive particles 137, the cross-linked binder 138, and a plurality of water-soluble particles 139. The water-soluble particles are generally insoluble in the binder precursor used to form the abrasive composites. When the abrasive article is exposed to water during use, the water-soluble particles begin to dissolve. Thus, the abrasive article can be made more erodible enhancing its performance for some applications such as removing defects in harder automotive clear coats such as PPG Industries 9911.

The inventors have determined that plasma treatment of the abrasive article can be used to expose the water-soluble particles within the cross-linked binder thereby enhancing the breakdown of the abrasive composites. Furthermore, use of the water-soluble particles without plasma treatment of the resulting abrasive article did not significantly enhance the performance as shown in the Examples. Thus, the combination of the water-soluble particles with the plasma treatment produced an abrasive article having superior performance for some applications.

The water-soluble particle may be a water-soluble inorganic or organic particle, such as an organic salt or a soluble polymer particle. Suitable water-soluble particles include, for example, sugar, powdered sugar, dextrose, di- and polysaccharides, starch, soluble salts such as metal halide salts, polyvinyl acetate, polyacrylamide, methyl cellulose, carboxymethyl cellulose, hydroxyethyl cellulose, dextran, polyvinyl alcohol, xanthan gum, guar gum, or mixtures thereof. The average particle size of the water-soluble particles may range between about 0.05 and about 500 micrometers, or between about 1 to 100 micrometers. The water-soluble particles may be mixed into the slurry used to form the abrasive composites at between about 0.5 and about 70 percent by weight, or between about 1 and about 30 percent by weight, or between about 3 and about 20 percent by weight, or between about 0.5 percent to about 8 percent by weight, or between about 1 percent to about 7 percent by weight.

In one embodiment of the invention, the water-soluble particles are readily soluble in water. In other embodiments of the invention, at least 5 grams, at least 10 grams, at least 20 grams, at least 30 grams, or at least 40 grams of the water-soluble particles are soluble in 100 grams of water at 25 degrees Celsius.

Figure 5:
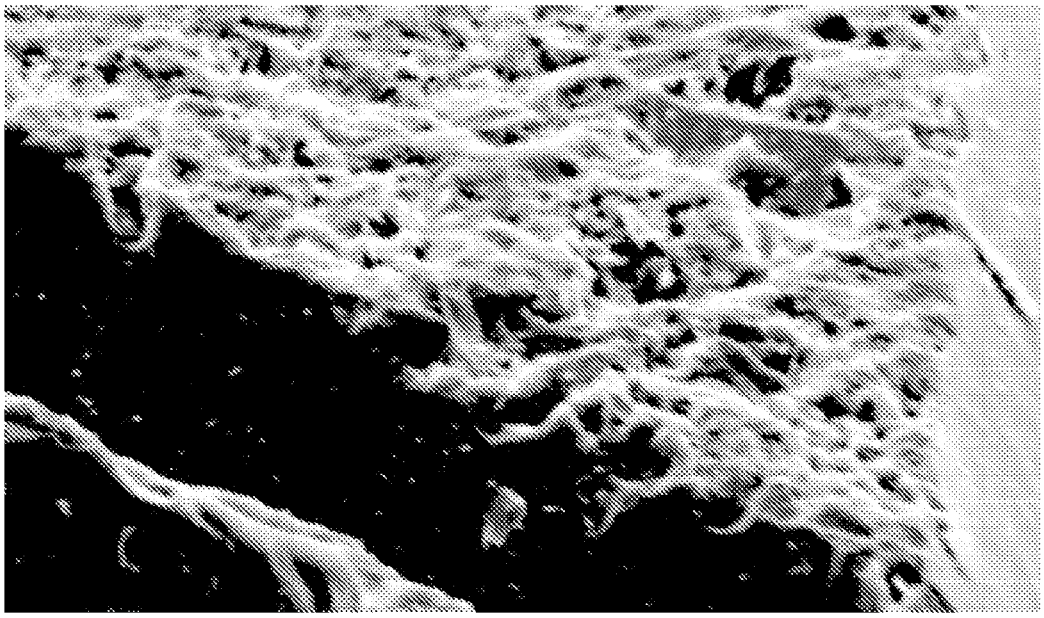
FIG. 5 is a scanning electron micrograph of the outer surface of a structured abrasive layer after preconditioning with another abrasive article taken at approximately 2,000× magnification.
Figure 6:
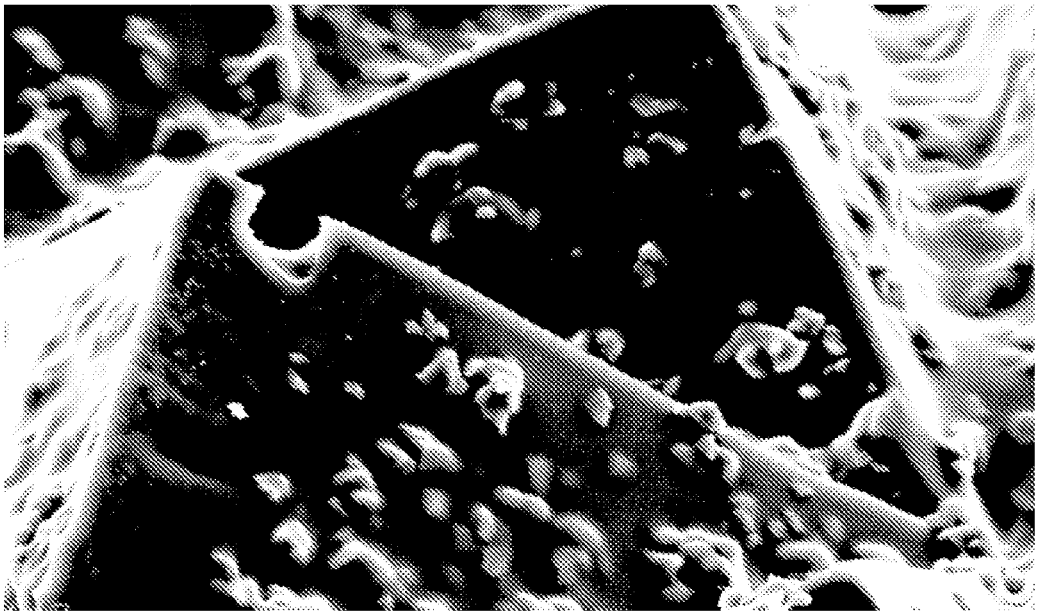
FIG. 6 is a scanning electron micrograph of the outer surface of a structured abrasive layer having abrasive particles positioned with a water-soluble polymer taken at approximately 1,000× magnification.

Referring now to FIGS. 5-6, the structured abrasive layer of three comparative abrasive articles is shown. In FIG. 5, an abrasive article similar to the abrasive article shown in FIGS. 1-4 was preconditioned by abrading the outer surface with another abrasive article. As seen, only the tops of the shaped abrasive composites within the structured abrasive layer have been altered. The sides and the valleys between the shaped abrasive composites are unchanged. In the abraded top of the shaped abrasive composites, individual abrasive grains are not discernable at 2,000 times magnification. In comparison, in FIGS. 2A and 2B at only 800 times magnification individual precisely-exposed abrasive particles are readily discernable after only two minutes of plasma treatment.

In FIG. 6, an abrasive article made according to the disclosure of U.S. patent application Ser. No. 11/777,701 entitled "Structured Abrasive with Overlay, and Method of Making and Using the Same" filed on Jul. 13, 2007 is shown. A mixture of abrasive particles and polyvinyl alcohol was applied to an abrasive article having a structured abrasive layer comprising pyramidal shaped abrasive composites. As seen, the abrasive particles on the structured abrasive layer are not precisely-exposed. The edges of the abrasive particles are not sharp and distinct even at 2,000 time magnification unlike the edges of the precisely-exposed abrasive particles shown in FIGS. 2-4 at only 800 times magnification. Note particularly in the valleys between adjacent shaped abrasive composites how individual abrasive particles are not discernable. Additionally, more of the abrasive particles can collect in the valleys and lower portions of the structured abrasive layer with fewer abrasive particles on the peaks and faces of the shaped abrasive composites resulting in a non-uniformity of the abrasive particles.

Figure 7:
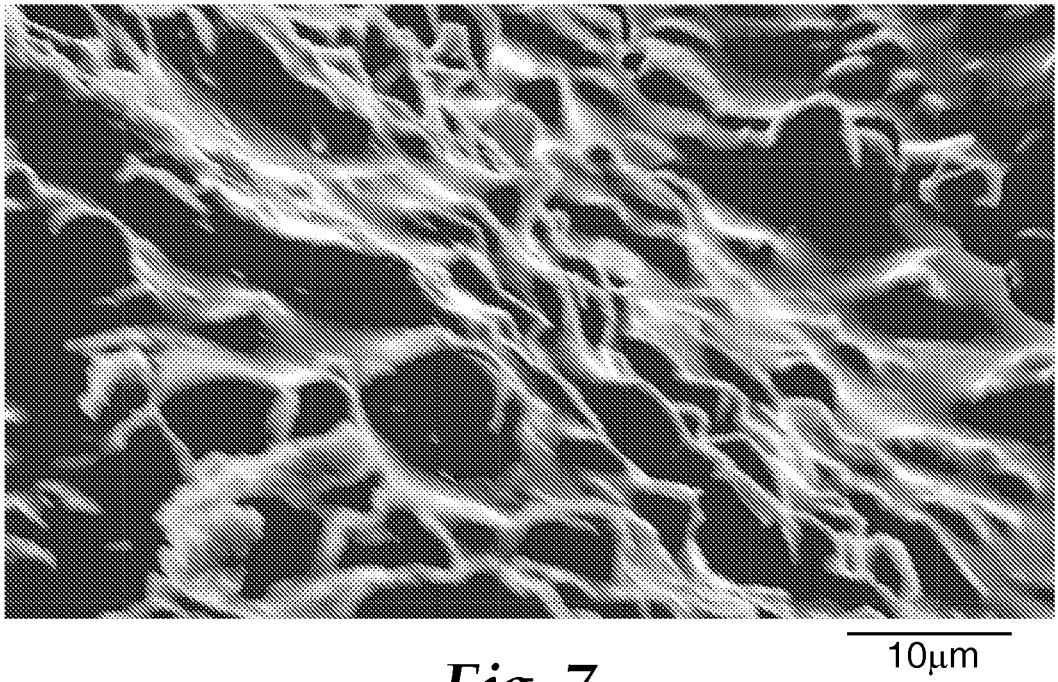
FIG. 7 is a scanning electron micrograph of the outer surface of a prior-art structured abrasive layer for the commercial product NORAX U321X5 available from Saint-Gobain Abrasives Technology Company taken at approximately 2000× magnification.

In FIG. 7, a commercially available abrasive article having a structured abrasive layer marketed under the trade designation "NORAX U321×5" made by Saint-Gobain Abrasives Company is shown. The abrasive article is believed to be made according to the disclosure of U.S. Pat. No. 6,451,076 where a top size coat is put over an embossed, structured abrasive layer. As seen at 2,000 time magnification, the abrasive particles are entirely covered by the top size coating and not precisely-exposed as shown in FIGS. 2-4.

The abrasive articles of FIGS. 2-4 were made by subjecting the abrasive article to plasma to uniformly expose the abrasive particles at all positions within the structured abrasive layer. The conditions of the plasma treatment are adjusted for isotropic etching of the structured abrasive layer uniformly eroding the cross-linked binder even though there are significant height and geometry variations within the structured abrasive layer.

During plasma treatment, plasma created in the apparatus from the gas within the chamber is generated and sustained by supplying power (for example, from an RF generator operating at a frequency in the range of 0.001 to 100 MHz) to at least one electrode. The electrode system may be symmetric or asymmetric. In some plasma apparatus, electrode surface area ratios between grounded and powered electrodes are from 2:1 to 4:1, or from 3:1 to 4:1. The powered electrode may be cooled, e.g., with water. For discrete relatively planar objects such as abrasive articles, plasma deposition can be achieved, for example, by placing the articles in direct contact with the smaller electrode of an asymmetric electrode configuration. This allows the article to act as an electrode due to capacitive coupling between the powered electrode and the article.

The RF power source provides power at a typical frequency in the range of 0.01 to 50 MHz, or 13.56 MHz or any whole number (e.g., 1, 2, or 3) multiple thereof. The RF power source can be an RF generator such as a 13.56 MHz oscillator. To obtain efficient power coupling (i.e., wherein the reflected power is a small fraction of the incident power), the power source may be connected to the electrode via a network that acts to match the impedance of the power supply with that of the transmission line (which is usually 50 ohms reactive) so as to effectively transmit RF power through a coaxial transmission line. One type of matching network, which includes two variable capacitors and an inductor, is available under the designation AMN 3000 from Plasmatherm of St. Petersburg, Fla. Traditional methods of power coupling involve the use of a blocking capacitor in the impedance matching network between the powered electrode and the power supply. This blocking capacitor prevents the DC bias voltage from being shunted out to the rest of the electrical circuitry. Instead, the DC bias voltage is shunted out in a grounded electrode. While the acceptable frequency range from the RF power source may be high enough to form a large negative DC self bias on the smaller electrode, it should not be so high that it creates standing waves in the resulting plasma, which is inefficient for plasma treatment.

In addition to batch treatment of the abrasive articles, rolls or continuous webs of the abrasive material can be treated using a continuous plasma reactor using techniques as described in U.S. Pat. Nos. 5,888,594; 5,948,166; 7,195,360;

and in U.S. patent application publication number U.S. 2003/0134515. A continuous plasma treatment apparatus typically includes a rotating drum electrode which may be powered by a radio frequency (RF) power source, a grounded chamber which acts as a grounded electrode, a feed reel which continuously supplies to-be-treated articles in the form of a continuous moving web, and a take-up reel which collects the treated article. The feed and take up reels are optionally enclosed within the chamber, or can be operated outside of the chamber as long as a low-pressure plasma can be maintained within the chamber. If desired, a concentric grounded electrode can be added near the powered drum electrode for additional spacing control. An inlet supplies suitable treatment gases in vapor or liquid form to the chamber.

In this disclosure, the structured abrasive layer is uniformly plasma treated by using alone or in combination, higher gas pressures, longer treatment times, higher power settings, or fluorocarbon gases in combination with oxygen to provide isotropic plasma etching conditions. The isotropic plasma etching conditions can use either pure oxygen gas at higher pressures or a combination of $O_2$ and $C_3F_8$ gases at lower pressures. Treatment gas pressures are generally from 50 milliTorr to 10,000 milliTorr, or from 60 milliTorr to 1,000 milliTorr, or from 250 milliTorr to 550 milliTorr. Treatment times are generally from 2 minutes to 15 minutes, or from 4 minutes to 12 minutes, or from 5 minutes to 10 minutes. Treatment gases include, for example, either pure oxygen or a mixture of oxygen and $C_3F_8$. A ratio for the flow rate of the $C_3F_8$ gas divided by a total combined flow rate of the $C_3F_8$ gas and the $O_2$ gas is generally from 0.10 to 0.30, or from 0.15 to 0.25 and the total combined gas flow rates are typically 0.1 to 10 liters/min. Treatment power setting for the plasma etching process are generally from 0.1 to 1.0 watts/sq. cm of the electrode area.

Although the plasma treatment was carried out with structured abrasive articles in FIGS. 2-4, other abrasive articles can be treated by being subjected to plasma to alter the surface properties of the outer surface. Suitable abrasive articles for plasma treatment include, for example, bonded abrasive articles such as grinding wheels, coated abrasive articles with an abrasive layer or a structured abrasive layer on a backing, and nonwoven abrasive articles comprising a fiber matrix, binder, and abrasive particles.

With regard to coated abrasive articles as shown in FIG. 1, suitable backings include, for example, polymeric films (including primed polymeric film), cloth, paper, foraminous and non-foraminous polymeric foam, vulcanized fiber, fiber reinforced thermoplastic backing, meltspun or meltblown nonwovens, treated versions thereof (e.g., with a waterproofing treatment), and combinations thereof. Suitable thermoplastic polymers for use in polymeric films include, for example, polyolefins (e.g., polyethylene and polypropylene), polyesters (e.g., polyethylene terephthalate), polyamides (e.g., nylon-6 and nylon-6,6), polyimides, polycarbonates, blends thereof, and combinations thereof.

Typically, at least one major surface of the backing is smooth (for example, to serve as the first major surface). The second major surface of the backing may comprise a slip resistant or frictional coating. Examples of such coatings include an inorganic particulate (e.g., calcium carbonate or quartz) dispersed in an adhesive.

The backing may contain various additive(s). Examples of suitable additives include colorants, processing aids, reinforcing fibers, heat stabilizers, UV stabilizers, and antioxidants. Examples of useful fillers include clays, calcium carbonate, glass beads, talc, clays, mica, wood flour; and carbon black. In some embodiments, the backing may be a composite film such as, for example, a coextruded film having two or more discrete layers.

The structured abrasive layer can have pyramidal abrasive composites arrayed in a close-packed arrangement to form raised abrasive regions. The raised abrasive regions are typically identically shaped and arranged on the backing according to a repeating pattern, although neither of these is a requirement.

The term pyramidal abrasive composite refers to an abrasive composite having the shape of a pyramid, that is, a solid figure with a polygonal base and triangular faces that meet at a common point (apex). Examples of types of suitable pyramid shapes include three-sided, four-sided, five-sided, six-sided pyramids, and combinations thereof. The pyramids may be regular (that is, all sides the same) or irregular. The height of a pyramid is the least distance from the apex to the base.

The term truncated pyramidal abrasive composite refers to an abrasive composite having the shape of a truncated pyramid, that is, a solid figure with a polygonal base and triangular faces that meet at a common point, wherein the apex is cut off and replaced by a plane that is parallel to the base. Examples of types of suitable truncated pyramid shapes include three-sided, four-sided, five-sided, six-sided truncated pyramids, and combinations thereof. The truncated pyramids may be regular (that is, all sides the same) or irregular. The height of a truncated pyramid is the least distance from the apex to the base.

For fine finishing applications, the height of the pyramidal abrasive composites (i.e., not truncated) is generally greater than or equal to 1 mil (25.4 micrometers) and less than or equal to 20 mils (510 micrometers); for example, less than 15 mils (380 micrometers), 10 mils (250 micrometers), 5 mils (130 micrometers), 2 mils (50 micrometers), although greater and lesser heights may also be used.

In one embodiment, the structured abrasive layer 130 was a continuous network consisting essentially of close-packed truncated pyramidal abrasive composites that continuously abuts and separates the raised abrasive regions from one another. As used herein, the term "continuously abuts" means that the network is proximal to each of the raised abrasive portions, for example, in a close-packed arrangement of truncated pyramidal abrasive composites and pyramidal abrasive composites. The network may be formed along straight lines, curved lines, or segments thereof, or a combination thereof. Typically, the network extends throughout the structured abrasive layer; more typically, the network has a regular arrangement (e.g., a network of intersecting parallel lines or a hexagonal pattern). In some embodiments, the network has a least width of at least twice the height of the pyramidal abrasive composites.

The ratio of the height of the truncated pyramidal abrasive composites to the height of the pyramidal abrasive composites is less than one, typically in a range of from at least 0.05, 0.1, 0.15, or even 0.20 up to and including 0.25, 0.30, 0.35, 0.40, 0.45, 0.5 or even 0.8, although other ratios may be used. More typically, the ratio is in a range of from at least 0.20 up to and including 0.35.

For fine finishing applications, the areal density of the pyramidal and/or truncated pyramidal abrasive composites in the structured abrasive layer is typically in a range of from at least 1,000, 10,000, or even at least 20,000 abrasive composites per square inch (e.g., at least 150, 1,500, or even 7,800 abrasive composites per square centimeter) up to and including 50,000, 70,000, or even as many as 100,000 abrasive composites per square inch (up to and including 7,800, 11,000, or even as many as 15,000 abrasive composites per square centimeter), although greater or lesser densities of abrasive composites may also be used.

The pyramidal to truncated pyramidal base ratio, that is, the ratio of the combined area of the bases of the pyramidal abrasive composites to the combined area of the bases of the truncated pyramidal abrasive composites may affect cut and/or finish performance of the structured abrasive articles of the present invention. For fine finishing applications, the pyramidal to truncated pyramidal base ratio is typically in a range of from 0.8 to 9, for example, in a range of from 1 to 8, 1.2 to 7, or 1.2 to 2, although ratios outside of these ranges may also be used.

Individual shaped abrasive composites (whether pyramidal, truncated pyramidal, or other shape) comprise abrasive grains dispersed in a cross-linked polymeric binder. Any abrasive grain known in the abrasive art may be included in the abrasive composites. Examples of useful abrasive grains include aluminum oxide, fused aluminum oxide, heat-treated aluminum oxide (which includes brown aluminum oxide, heat treated aluminum oxide, and white aluminum oxide), ceramic aluminum oxide, silicon carbide, green silicon carbide, alumina-zirconia, chromia, ceria, iron oxide, garnet, diamond, cubic boron nitride, and combinations thereof. For repair and finishing applications, useful abrasive grain sizes typically range from an average particle size of from at least 0.01, 0.1, 1, 3 or even 5 micrometers up to and including 35, 50, 100, 250, 500, or even as much as 1,500 micrometers, although particle sizes outside of this range may also be used. The abrasive grain may be bonded together (by other than the binder) to form an agglomerate, such as described, for example, in U.S. Pat. No. 4,311,489 (Kressner); and U.S. Pat. Nos. 4,652,275 and 4,799,939 (both to Bloecher et al.).

The abrasive grain may have a surface treatment thereon. In some instances, the surface treatment may increase adhesion to the binder, alter the abrading characteristics of the abrasive particle, or the like. Examples of surface treatments include coupling agents, halide salts, metal oxides including silica, refractory metal nitrides, and refractory metal carbides.

The shaped abrasive composites (whether pyramidal, truncated pyramidal, or other shape) may also comprise diluent particles, typically on the same order of magnitude as the abrasive particles. Examples of such diluent particles include gypsum, marble, limestone, flint, silica, glass bubbles, glass beads, and aluminum silicate.

The abrasive particles are dispersed in a cross-linked binder to form the shaped abrasive composite. The cross-linked binder can be a thermoplastic binder, however, it is typically a thermosetting binder. The cross-linked binder is formed from a binder precursor. During the manufacture of the abrasive article, the thermosetting binder precursor is exposed to an energy source which aids in the initiation of the polymerization or curing process to cross link the binder. Examples of energy sources include thermal energy and radiation energy which includes electron beam, ultraviolet light, and visible light.

After this polymerization process, the binder precursor is converted into a solidified cross-linked binder. Alternatively for a crosslinkable thermoplastic binder precursor, during the manufacture of the abrasive article the thermoplastic binder precursor is cooled to a degree that results in solidification of the binder precursor. Upon solidification of the binder precursor, the abrasive composite is formed.

There are two main classes of thermosetting resins, condensation curable and addition polymerizable resins. Addition polymerizable resins are advantageous because they are readily cured by exposure to radiation energy. Addition polymerized resins can polymerize through a cationic mechanism or a free radical mechanism. Depending upon the energy source that is utilized and the binder precursor chemistry, a curing agent, initiator, or catalyst is sometimes preferred to help initiate the polymerization.

Examples of typical binder precursors include phenolic resins, urea-formaldehyde resins, aminoplast resins, urethane resins, melamine formaldehyde resins, cyanate resins, isocyanurate resins, acrylate resins (e.g., acrylated urethanes, acrylated epoxies, ethylenically unsaturated compounds, aminoplast derivatives having pendant alpha,beta-unsaturated carbonyl groups, isocyanurate derivatives having at least one pendant acrylate group, and isocyanate derivatives having at least one pendant acrylate group) vinyl ethers, epoxy resins, and mixtures and combinations thereof. The term acrylate encompasses acrylates and methacrylates. In some embodiments, the binder is selected from the group consisting of acrylics, phenolics, epoxies, urethanes, cyanates, isocyanurates, aminoplasts, and combinations thereof.

Phenolic resins are suitable for this invention and have good thermal properties, availability, and relatively low cost and ease of handling. There are two types of phenolic resins, resole and novolac. Resole phenolic resins have a molar ratio of formaldehyde to phenol of greater than or equal to one to one, typically between 1.5:1.0 to 3.0:1.0. Novolac resins have a molar ratio of formaldehyde to phenol of less than one to one. Examples of commercially available phenolic resins include those known by the trade designations "DUREZ" and "VARCUM" from Occidental Chemicals Corp., Dallas, Tex.; "RESINOX" from Monsanto Co., Saint Louis, Mo.; and "AEROFENE" and "AROTAP" from Ashland Specialty Chemical Co., Dublin, Ohio.

Acrylated urethanes are diacrylate esters of hydroxy terminated NCO extended polyesters or polyethers. Examples of commercially available acrylated urethanes include those available under the trade designations "UVITHANE 782" from Morton Thiokol Chemical, and "CMD 6600", "CMD 8400", and "CMD 8805" from UCB Radcure, Smyrna, Ga.

Acrylated epoxies are diacrylate esters of epoxy resins, such as the diacrylate esters of bisphenol A epoxy resin. Examples of commercially available acrylated epoxies include those available under the trade designations "CMD 3500", "CMD 3600", and "CMD 3700" from UCB Radcure.

Ethylenically unsaturated resins include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 g/mole and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyl-oxyethyl) isocyanurate, 1,3,5-tri(2-methyacryloxyethyl)-s-triazine, acrylamide, methylacrylamide, N-methylacrylamide, N,N-dimethylacrylamide, N-vinylpyrrolidone, and N-vinylpiperidone.

The aminoplast resins have at least one pendant alpha, beta-unsaturated carbonyl group per molecule or oligomer. These unsaturated carbonyl groups can be acrylate, methacrylate, or acrylamide type groups. Examples of such materials include N-(hydroxymethyl)acrylamide, N,N'-oxydimethylenebisacrylamide, ortho and para acrylamidomethylated phenol, acrylamidomethylated phenolic novolac, and combinations thereof. These materials are further described in U.S. Pat. Nos. 4,903,440 and 5,236,472 (both to Kirk et al.).

Isocyanurate derivatives having at least one pendant acrylate group and isocyanate derivatives having at least one pendant acrylate group are further described in U.S. Pat. No. 4,652,274 (Boettcher et al.). An example of one isocyanurate material is the triacrylate of tris(hydroxy ethyl) isocyanurate.

Epoxy resins have an oxirane and are polymerized by the ring opening. Such epoxide resins include monomeric epoxy resins and oligomeric epoxy resins. Examples of useful epoxy resins include 2,2-bis[4-(2,3-epoxypropoxy)-phenyl propane] (diglycidyl ether of bisphenol) and materials available under the trade designations "EPON 828", "EPON 1004", and "EPON 1001F" from Shell Chemical Co., Houston, Tex.; and "DER-331", "DER-332", and "DER-334" from Dow Chemical Co., Midland, Mich. Other suitable epoxy resins include glycidyl ethers of phenol formaldehyde novolac commercially available under the trade designations "DEN-431" and "DEN-428" from Dow Chemical Co.

The epoxy resins of the invention can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid.

Other cationic curing agents include a salt having an organometallic complex cation and a halogen containing complex anion of a metal or metalloid which are further described in U.S. Pat. No. 4,751,138 (Tumey et al.). Another example is an organometallic salt and an onium salt is described in U.S. Pat. No. 4,985,340 (Palazzotto et al.); U.S. Pat. No. 5,086,086 (Brown-Wensley et al.); and U.S. Pat. No. 5,376,428 (Palazzotto et al.). Still other cationic curing agents include an ionic salt of an organometallic complex in which the metal is selected from the elements of Periodic Group IVB, VB, VIB, VIIB and VIIIB which is described in U.S. Pat. No. 5,385,954 (Palazzotto et al.).

Regarding free radical curable resins, in some instances it is preferred that the abrasive slurry further comprise a free radical curing agent. However in the case of an electron beam energy source, the curing agent is not always required because the electron beam itself generates free radicals.

Examples of free radical thermal initiators include peroxides, e.g., benzoyl peroxide, azo compounds, benzophenones, and quinones. For either ultraviolet or visible light energy source, this curing agent is sometimes referred to as a photoinitiator. Examples of initiators, that when exposed to ultraviolet light generate a free radical source, include but are not limited to those selected from the group consisting of organic peroxides, azo compounds, quinones, benzophenones, nitroso compounds, acryl halides, hydrozones, mercapto compounds, pyrylium compounds, triacrylimidazoles, bisimidazoles, chloroalkytriazines, benzoin ethers, benzil ketals, thioxanthones, and acetophenone derivatives, and mixtures thereof. Examples of initiators that, if exposed to visible radiation, generate a free radical source can be found in U.S. Pat. No. 4,735,632 (Oxman et al.). One suitable initiator for use with visible light is available under the trade designation "IRGACURE 369" from Ciba Specialty Chemicals, Tarrytown, N.Y.

Abrasive articles having a structured abrasive layer can be prepared by forming a slurry of abrasive grains and a solidifiable or polymerizable precursor of the abovementioned binder resin (i.e., a binder precursor), contacting the slurry with a backing and solidifying and/or polymerizing the binder precursor (e.g., by exposure to an energy source) in a manner such that the resulting structured abrasive article has a plurality of shaped abrasive composites affixed to the backing Examples of energy sources include thermal energy and radiant energy (including electron beam, ultraviolet light, and visible light).

The abrasive slurry is made by combining together by any suitable mixing technique the binder precursor, the abrasive grains and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles are gradually added into the binder precursor. The amount of air bubbles in the abrasive slurry can be minimized by pulling a vacuum either during or after the mixing step. In some instances, it is useful to heat, generally in the range of 30 to 70 degrees C., the abrasive slurry to lower the viscosity.

For example, in one embodiment, the slurry may be coated directly onto a production tool having shaped cavities (corresponding to the desired structured abrasive layer) therein, and brought into contact with the backing, or coated on the backing and brought to contact with the production tool. The slurry is typically then solidified (e.g., a least partially cured) or cured while it is present in the cavities of the production tool, and the backing is separated from the tool thereby forming an abrasive article with a structured abrasive layer.

In one embodiment, the surface of the production tool may consist essentially of a close packed array of cavities comprising: pyramidal cavities (e.g., selected from the group consisting of three-sided pyramidal cavities, four-sided pyramidal cavities, five-sided pyramidal cavities, six-sided pyramidal cavities, and combinations thereof); and truncated pyramidal cavities (e.g., selected from the group consisting of truncated three-sided pyramidal cavities, truncated four-sided pyramidal cavities, truncated five-sided pyramidal cavities, truncated six-sided pyramidal cavities, and combinations thereof). In some embodiments, the ratio of the depth of the truncated pyramidal cavities to the depth of the pyramidal cavities is in a range of from 0.2 to 0.35. In some embodiments, the depth of the pyramidal cavities is in a range of from 1 to 10 micrometers. In some embodiments, the pyramidal and truncated pyramidal cavities each have an areal density of greater than or equal to 150 cavities per square centimeter.

The production tool can be a belt, a sheet, a continuous sheet or web, a coating roll such as a rotogravure roll, a sleeve mounted on a coating roll, or die. The production tool can be composed of metal, (e.g., nickel), metal alloys, or plastic. The metal production tool can be fabricated by any conventional technique such as, for example, engraving, bobbing, electroforming, or diamond turning.

A thermoplastic tool can be replicated off a metal master tool. The master tool will have the inverse pattern desired for the production tool. The master tool can be made in the same manner as the production tool. The master tool is preferably made out of metal, e.g., nickel and is diamond turned. The thermoplastic sheet material can be heated and optionally along with the master tool such that the thermoplastic material is embossed with the master tool pattern by pressing the two together. The thermoplastic can also be extruded or cast onto the master tool and then pressed. The thermoplastic material is cooled to solidify and produce the production tool.

Examples of preferred thermoplastic production tool materials include polyester, polycarbonates, polyvinyl chloride, polypropylene, polyethylene and combinations thereof. If a thermoplastic production tool is utilized, then care must be taken not to generate excessive heat that may distort the thermoplastic production tool.

The production tool may also contain a release coating to permit easier release of the abrasive article from the production tool. Examples of such release coatings for metals include hard carbide, nitrides or borides coatings. Examples of release coatings for thermoplastics include silicones and fluorochemicals.

Further details concerning structured abrasive articles having precisely shaped abrasive composites, and methods for their manufacture may be found, for example, in U.S. Pat. No. 5,152,917 (Pieper et al.); U.S. Pat. No. 5,435,816 (Spurgeon et al.); U.S. Pat. No. 5,672,097 (Hoopman); U.S. Pat. No. 5,681,217 (Hoopman et al.); U.S. Pat. No. 5,454,844 (Hibbard et al.); U.S. Pat. No. 5,851,247 (Stoetzel et al.); and U.S. Pat. No. 6,139,594 (Kincaid et al.).

In another embodiment, a slurry comprising a polymerizable binder precursor, abrasive grains, and a silane coupling agent may be deposited on a backing in a patterned manner (e.g., by screen or gravure printing), partially polymerized to render at least the surface of the coated slurry plastic but non-flowing, a pattern embossed upon the partially polymerized slurry formulation, and subsequently further polymerized (e.g., by exposure to an energy source) to form a plurality of shaped abrasive composites affixed to the backing. Such embossed abrasive articles having a structured abrasive layer prepared by this and related methods are described, for example, in U.S. Pat. No. 5,833,724 (Wei et al.); U.S. Pat. No. 5,863,306 (Wei et al.); U.S. Pat. No. 5,908,476 (Nishio et al.); U.S. Pat. No. 6,048,375 (Yang et al.); U.S. Pat. No. 6,293,980 (Wei et al.); and U.S. patent application number 2001/0041511 (Lack et al.).

The back side of the abrasive article may be printed with pertinent information according to conventional practice to reveal information such as, for example, product identification number, grade number, and/or manufacturer. Alternatively, the front surface of the backing may be printed with this same type of information. The front surface can be printed if the abrasive composite is translucent enough for print to be legible through the abrasive composites.

Coated abrasive articles according to the present invention may optionally have an attachment interface layer affixed to the second major surface of the backing to facilitate securing the abrasive article to a support pad or back-up pad secured to a tool such as, for example, a random orbit sander. The optional attachment interface layer may be an adhesive (e.g., a pressure sensitive adhesive) layer or a double-sided adhesive tape. The optional attachment interface layer may be adapted to work with one or more complementary elements affixed to the support pad or back up pad in order to function properly. For example, the optional attachment interface layer may comprise a loop fabric for a hook and loop attachment (e.g., for use with a backup or support pad having a hooked structure affixed thereto), a hooked structure for a hook and loop attachment (e.g., for use with a backup or support pad having a looped fabric affixed thereto), or an intermeshing attachment interface layer (e.g., mushroom type interlocking fasteners designed to mesh with a like mushroom type interlocking fastener on a back up or support pad). Further details concerning such attachment interface layers may be found, for example, in U.S. Pat. No. 4,609,581 (Ott); U.S. Pat. No. 5,152,917 (Pieper et al.); U.S. Pat. No. 5,254,194 (Ott); U.S. Pat. No. 5,454,844 (Hibbard et al.); U.S. Pat. No. 5,672,097 (Hoopman); U.S. Pat. No. 5,681,217 (Hoopman et al.); and U.S. patent applications 2003/0143938 (Braunschweig et al.) and 2003/0022604 (Annen et al.).

Likewise, the second major surface of the backing may have a plurality of integrally formed hooks protruding therefrom, for example, as described in U.S. Pat. No. 5,672,186 (Chesley et al.). These hooks will then provide the engagement between the structured abrasive article and a back up pad that has a loop fabric affixed thereto.

Abrasive articles according to the present invention can be any shape, for example, round (e.g., a disc), oval, scalloped edges, or rectangular (e.g., a sheet) depending on the particular shape of any support pad that may be used in conjunction therewith, or they may have the form of an endless belt. The structured abrasive articles may have slots or slits therein and may be provided with perforations (e.g., a perforated disk).

Abrasive articles according to the present invention are generally useful for abrading a workpiece, and especially those work pieces having a hardened polymeric layer thereon. However, the workpiece may comprise any material and may have any form. Examples of materials include metal, metal alloys, exotic metal alloys, ceramics, painted surfaces, plastics, polymeric coatings, stone, polycrystalline silicon, wood, marble, and combinations thereof. Examples of work pieces include molded and/or shaped articles (e.g., optical lenses, automotive body panels, boat hulls, counters, and sinks), wafers, sheets, and blocks.

Abrasive articles having a structured abrasive layer according to the present invention are typically useful for repair and/or polishing of polymeric coatings such as motor vehicle paints and clearcoats (e.g., automotive clearcoats), examples of which include: polyacrylic-polyol-polyisocyanate compositions (e.g., as described in U.S. Pat. No. 5,286,782 (Lamb, et al.); hydroxyl functional acrylic-polyol-polyisocyanate compositions (e.g., as described in U.S. Pat. No. 5,354,797 (Anderson, et al.); polyisocyanate-carbonate-melamine compositions (e.g., as described in U.S. Pat. No. 6,544,593 (Nagata et al.); and high solids polysiloxane compositions (e.g., as described in U.S. Pat. No. 6,428,898 (Barsotti et al.)).

Depending upon the application, the force at the abrading interface can range from about 0.1 kg to over 1000 kg. Generally, this range is between 1 kg to 500 kg of force at the abrading interface. Also, depending upon the application there may be a liquid present during abrading. This liquid can be water and/or an organic compound. Examples of typical organic compounds include lubricants, oils, emulsified organic compounds, cutting fluids, surfactants (e.g., soaps, organosulfates, sulfonates, organophosphonates, organophosphates), and combinations thereof. These liquids may also contain other additives such as defoamers, degreasers, corrosion inhibitors, and combinations thereof.

Abrasive articles according to the present invention may be used, for example, with a rotary tool that rotates about a central axis generally perpendicular to the structured abrasive layer, or with a tool having a random orbit (e.g., a random orbital sander), and may oscillate at the abrading interface during use. In some instances, this oscillation may result in a finer surface on the workpiece being abraded.

EXAMPLES

Objects and advantages of this invention are further illustrated by the following non-limiting examples, but the particular materials and amounts thereof recited in these examples, as well as other conditions and, details, should not be construed to unduly limit this invention. Unless otherwise noted, all parts, percentages, ratios, etc. in the Examples and the rest of the specification are by weight.

| Materials | |
|---|---|
| 466LA | 466LA - 3M TRIZACT FINESSE-IT FILM commercially available from 3M Corporation, Saint Paul, MN. |
| 460LA | 460LA - 3M TRIZACT FINESSE-IT FILM commercially available from 3M Corporation, Saint Paul, MN. |
| NORAX | NORAX U321X5 commercially available from Saint-Gobain Abrasives Company. |
| Powdered Sugar | 12x powdered sugar commercially available from United Sugar Company. |
| Dextran | Polysaccharide obtained from Sigma-Aldrich, Inc. St. Louis, Missouri as "D4133" |
| SR339 | 2-phenoxy ethylacrylate, commercially available under the trade designation "SR339" from Sartomer Company, Inc., Exton, Pennsylvania |
| SR351 | Trimethylolpropane triacrylate, commercially available under the trade designation "SR351" from Sartomer Company, Inc., Exton, Pennsylvania. |
| A174 | Gamma-methacryloxypropyltrimethoxysilane, commercially available under the trade designation "A174" from Crompton Corporation, Middlebury, Conn. |
| TPO-L | Acylphosphine oxide, commercially available under the trade designation "LUCERIN TPO-L" from BASF Corporation, Florham Park, NJ. |
| D520 | Phosphated Copolymer (Sulplus D520) commercially available from Lubrizol Corporation, Wickliffe, OH |
| OX-50 | Silicon dioxide OX50 Aerosil, commercially available under the trade "OX50" from Degussa Corporation, Parsippany, NJ |
| GC 3000 | Green Silicon Carbide mineral, commercially available under the trade designation "GC3000" from Fujimi Corporation, Elmhurst, ILL. |
| PPG9911 | An automotive Clear coat test panel, commercially available under the trade designation "9911 powder clear coat" from PPG Industries, Alison Park, PA. |
| DSP1 | Anionic polyester dispersant, obtained from Uniqema, New Castle, Delaware as "HYPERMER KD_10" |
| LP1 | 70 gsm loop fabric, obtained from Sitip SpA Industrie, Cene, Italy as "100% POLYAMIDE DAYTONA BRUSHED NYLON LOOP" |

Samples 11-19 were prepared as follows: An abrasive slurry, defined in parts by weight, was prepared as follows: 13.2 parts SR339, 20.0 parts SR351, 0.5 parts DSP1, 2.0 part A174, 1.1 parts TPO-L and 63.2 parts GC 3000 were homogeneously dispersed for approximately 15 minutes at 20 degrees C. using a laboratory air mixer. The slurry was applied via knife coating to a 12-inch (30.5 cm) wide microreplicated polypropylene tooling having uniformly distributed, close packed, alternating 34 degree helical cut, pyramidal arrays having 11 by 11 rows of base width 3.3 mils by 3.3 mils (83.8 by 83.8 micrometers) by 2.5 mils (63.5 micrometers) depth, separated by 3 by 3 rows of the same pyramidal array truncated to a depth of 0.83 mil (21 micrometers), as shown in FIG. 1B. The tool was prepared from a corresponding master roll generally according to the procedure of U.S. Pat. No. 5,975,987 (Hoopman et al.). The slurry filled polypropylene tooling was then laid on a 12-inch (30.5-cm) wide web of ethylene acrylic acid primed polyester film, 3.71 mil (94.2 micrometers) thick, obtained under the trade designation "MA370M" from 3M Company, passed through a nip roll ((nip pressure of 90 pounds per square inch (psi) (620.5 kilopascals (kPa)) for a 10 inch (25.4 cm) wide web, and irradiated with an ultraviolet (UV) lamp, type "D" bulb, from Fusion Systems Inc., Gaithersburg, Md., at 600 Watts/inch (236 Watts/cm) while moving the web at 30 feet/minute (fpm) (9.14 meters/minute). The polypropylene tooling was separated from the ethylene acrylic acid primed polyester film, resulting in a fully cured precisely shaped abrasive layer adhered to ethylene acrylic acid primed polyester film. Pressure sensitive adhesive was laminated to the backside (opposite that abrasive layer) of the film and a sheet of LP1 was laminated to the pressure sensitive adhesive. Various disc sizes, ranging in diameter from 0.75-inch (1.91-cm) to 1.25-inch (3.18-cm) were then die cut from the abrasive material.

Samples 11-19: Raw Material Formulations Prior to Plasma Treatment

| Material | Control | 6% Sugar | 3% Sugar | 3% Dextran |
|---|---|---|---|---|
| SR339 | 807.6 | 807.6 | 807.6 | 807.6 |
| SR351 | 1221 | 1221 | 1221 | 1221 |
| A174 | 125.4 | 125.4 | 125.4 | 125.4 |
| TPO-L | 68.4 | 68.4 | 68.4 | 68.4 |
| D520 | 45.6 | 45.6 | 45.6 | 45.6 |
| OX-50 | 210 | 60 | 60 | 60 |
| Powder Sugar | 0 | 360 | 180 | 0 |
| Dextran | 0 | 0 | 0 | 180 |
| GC 3000 | 3323 | 3323 | 3323 | 3323 |

The abrasive articles were subjected to various plasma treatments as outlined in Tables 1 and 2 below with the exception of NORAX U321×5. Automotive clear coat test panels having a PPG 9911 clear coat over a painted surface were obtained from PPG Industries, Alison Park, Pa. The panels were inspected to locate defects, nibs, or dust specs in the clear coat. An orbital sander having a resilient backup pad was used with each of the structured abrasive articles to remove the identified defects. A running tally of the total number of defects able to be removed by each of the abrasive articles was recorded. As seen in Table 1, isotropic plasma etching significantly increased the number of defects able to be removed from the clear coat test panel over untreated sample number 7, which was unable to remove even a single defect.

TABLE 1

CUT RESULTS

| Sample | Abrasive Type | Gases | Flow sccm | Power watts/sq. cm | Time minutes | Pressure milliTorr | Defects Removed |
|---|---|---|---|---|---|---|---|
| 1 | 466LA | $C_3F_8$ | 80 | 0.54 | 10 | 300 | 13 |
| | | $O_2$ | 320 | | | | |
| 2 | 466LA | $C_3F_8$ | 80 | 0.54 | 10 | 50 | 10 |
| | | $O_2$ | 320 | | | | |
| 3 | 466LA | $C_3F_8$ | 80 | 0.54 | 5 | 300 | 7 |
| | | $O_2$ | 320 | | | | |
| 4 | 466LA | $C_3F_8$ | 80 | 0.54 | 10 | 300 | 12 |
| | | $O_2$ | 320 | | | | |
| 5 | 460LA | $C_3F_8$ | 80 | 0.54 | 10 | 50 | 1 |
| | | $O_2$ | 320 | | | | |
| 6 | NORAX | n.a. | n.a. | n.a. | n.a. | n.a. | 11 |
| 7 | 466LA | n.a. | n.a. | n.a. | n.a. | n.a. | 0 |

As seen in Table 2, the formulations containing water-soluble particles that were not plasma treated (Samples 11, 14, 17) were unable to remove any paint defects from harder powder clear coat. However, the formulations containing water-soluble particles that were plasma treated removed more defects (under the same plasma treatment conditions) than the formulations without water-soluble particles. For instance, Sample 8 without plasma treatment could only remove 3 defects before it was rendered inoperative while Sample 13 removed 7 defects.

Furthermore, less plasma treatment time is needed to render the abrasive article suitable for use. For instance, Sample 8 required 10 minutes of plasma treatment to begin to be able to remove defects while Sample 15 containing 3 percent sugar required only 5 minutes of plasma treatment and it was able to remove twice as many defects as Sample 8 even though the treatment time was significantly less.

TABLE 2

CUT RESULTS OF ABRASIVES WITH WATER-SOLUBLE PARTICLES

| Sample | Abrasive Type | Gases | Flow sccm | Power watts/sq. cm | Time minutes | Pressure milliTorr | Defects Removed |
|---|---|---|---|---|---|---|---|
| 8 | 460LA | C3F8 | 80 | 0.54 | 10 | 300 | 3 |
| | | O2 | 320 | | | | |
| 9 | 460LA | C3F8 | 80 | 0.54 | 5 | 300 | 0 |
| | | O2 | 320 | | | | |
| 10 | 460LA | C3F8 | 80 | 0.54 | 0 | 300 | 0 |
| | | O2 | 320 | | | | |
| 11 | 460LA - | C3F8 | 80 | | 0 | | 0 |
| | 6% sugar | O2 | 320 | | | | |
| 12 | 460LA - | C3F8 | 80 | 0.54 | 5 | 300 | 7 |
| | 6% sugar | O2 | 320 | | | | |
| 13 | 460LA - | C3F8 | 80 | 0.54 | 10 | 300 | 7 |
| | 6% sugar | O2 | 320 | | | | |
| 14 | 460LA - | C3F8 | 80 | | 0 | | 0 |
| | 3% sugar | O2 | 320 | | | | |
| 15 | 460LA - | C3F8 | 80 | 0.54 | 5 | 300 | 7 |
| | 3% sugar | O2 | 320 | | | | |
| 16 | 460LA - | C3F8 | 80 | 0.54 | 10 | 300 | 7 |
| | 3% sugar | O2 | 320 | | | | |
| 17 | 460LA - | C3F8 | 80 | | 0 | | 0 |
| | 3% Dextran | O2 | 320 | | | | |
| 18 | 460LA - | C3F8 | 80 | 0.54 | 5 | 300 | 0 |
| | 3% Dextran | O2 | 320 | | | | |
| 19 | 460LA - | C3F8 | 80 | 0.54 | 10 | 300 | 6 |
| | 3% Dextran | O2 | 320 | | | | |

Outer Surface Composition

The outer surface 118 of the structured abrasive layer was analyzed for chemical composition to determine changes to the outer surface by the plasma treatment. Five different products were tested. Commercially available products included 460LA and 466LA-3M TRIZACT FINESSE-IT FILM available from 3M Corporation and NORAX U321X5 available from Saint-Gobain Abrasives Corporation. Two plasma treated abrasive articles were also tested. The first plasma treated article was processed according to the conditions for sample 1 in Table 1. The second plasma treated article was treated using pure $O_2$ gas at a flow rate of 320 sccm, a pressure of 300 milliTorr and a power of 0.54 watts/sq. cm. The etching time duration was 10 minutes.

The samples were examined using X-ray photoelectron spectroscopy (XPS) also known as Electron Spectroscopy for Chemical Analysis (ESCA). XPS provides a quantitative measure of the elemental and chemical (oxidation state and/or functional group) composition for the outermost 30-100 angstroms of a sample surface. XPS is sensitive to all elements in the periodic table except hydrogen and helium. Typical detection limits for most species is in the 0.1 to 1 atomic % concentration range.

XPS data were acquired using a Kratos AXIS Ulta DLD spectrometer with a monochromatic Al-Ka X-ray source. The emitted photoelectrons were detected at a 90 degree take-off angle with respect to the sample surface. A low-energy electron flood gun was used to minimize surface charging. The area analyzed for each data point was approximately 700 um×300 um and randomly selected. Three areas on each sample were analyzed and averaged to obtain the reported atomic % values. Alternative equipment and measurement techniques can be used by those of skill in the art as long as the sample area remains the same and at least three data points per test sample are averaged.

Table 3 presents the results of the XPS analysis. As seen, samples treated with plasma had significantly lower carbon content in the outer surface as compared to the control samples. It is believed that exposure of the outer surface 180 to plasma causes a loss of carbon by ionization. Additionally, samples treated with an $O_2/C_3F_8$ plasma composition had elemental fluorine present in the outer layer as a result of the plasma treatment. Samples treated with $O_2$ plasma had a significantly higher oxygen concentration for the outer surface. The plasma treatment modified the atomic concentration of elements present in the outer surface of the abrasive article. In various embodiments of the invention, the carbon content of the outer surface can be less than 60, 50, 40, 30, 20, or 10 atomic percent. In various embodiments of the invention, the oxygen content of the outer layer can be greater than 30, 40, 50, or 60 atomic percent. The fluorine content of the outer layer can be greater than 1, 2, 5, 10, or 20 atomic percent.

TABLE 3

Atomic Composition Outer Surface

| Sample | C | O | Si | P | N | Al | F | Trace Elements <1 atomic % |
|---|---|---|---|---|---|---|---|---|
| 466LA TRIZACT | 83 | 14 | 2.5 | 1.0 | | | | |
| NORAX U321X5 | 71 | 20 | 5.1 | | 1.4 | 1.2 | | Na, Cl, K |
| 460LA TRIZACT | 78 | 22 | | | | | | Si |
| $O_2/C_3F_8$ Plasma | 53 | 6.5 | 28 | | | | 12 | Na, N |
| $O_2$ Plasma | 20 | 42 | 33 | 2.7 | | | 1.7 | Na, N |

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in their entirety in a consistent manner. In the event of inconsistencies or contradictions between the incorporated references and this application, the information in the preceding description shall control. The preceding description, in order to enable one of ordinary skill in the art to practice the claimed invention, is not to be construed as limiting the scope of the invention, which is defined by the claims and all equivalents thereto.

We claim:

1. A structured abrasive article comprising a structured abrasive layer attached to a first major surface of a backing, the structured abrasive layer comprising a plurality of shaped abrasive composites formed by a plurality of abrasive particles in a cross-linked binder, the structured abrasive layer having an outer surface and the outer surface comprising a carbon content of less than about 60 atomic %, and wherein the outer surface comprises a fluoride content of greater than about 5 atomic %.

2. The structured abrasive article of claim 1 wherein the outer surface comprises an oxygen content of greater than about 30 atomic %.

3. The structured abrasive article of claim 2 wherein the carbon content is less than about 30 atomic %.

4. The structured abrasive article of claim 1 wherein the plurality of shaped abrasive composites each comprises a precisely-shaped abrasive composite.

5. The structured abrasive article of claim 4 wherein the outer surface comprises an oxygen content of greater than about 30 atomic %.

6. The structured abrasive article of claim 5 wherein the carbon content is less than about 30 atomic %.

7. A structured abrasive article comprising a structured abrasive layer attached to a first major surface of a backing, the structured abrasive layer comprising a plurality of shaped abrasive composites formed by a plurality of abrasive particles in a cross-linked binder, the structured abrasive layer having an outer surface and the outer surface comprising a carbon content of less than about 60 atomic %, and wherein the outer surface comprises an oxygen content of greater than about 30 atomic % .

8. The structured abrasive article of claim 7 wherein the outer surface comprises a fluoride content of greater than about 5 atomic %.

9. The structured abrasive article of claim 7 wherein the carbon content is less than about 30 atomic %.

10. The structured abrasive article of claim 7 wherein the plurality of shaped abrasive composites each comprises a precisely-shaped abrasive composite.

11. The structured abrasive article of claim 10 wherein the outer surface comprises a fluoride content of greater than about 5 atomic %.

12. The structured abrasive article of claim 11 wherein the carbon content is less than about 30 atomic %.

* * * * *